United States Patent [19]

Tai

[11] Patent Number: 4,479,881

[45] Date of Patent: Oct. 30, 1984

[54] DETERGENT COMPOSITIONS

[75] Inventor: Ho T. Tai, Santes, France

[73] Assignee: Lever Brothers Company, New York, N.Y.

[21] Appl. No.: 584,671

[22] Filed: Feb. 29, 1984

[30] Foreign Application Priority Data

Mar. 10, 1983 [GB] United Kingdom ..... 8306645

[51] Int. Cl.[3] ..... D06M 13/46; C11D 17/00

[52] U.S. Cl. ..... 252/8.8; 252/174.12

[58] Field of Search ..... 252/8.8

[56] References Cited

U.S. PATENT DOCUMENTS 4,338,204 7/1982 Spadini et al. ..... 252/8.8
4,375,416 3/1983 Crisp et al. ..... 252/174

FOREIGN PATENT DOCUMENTS 26528 4/1981 European Pat. Off. .
1368599 10/1974 United Kingdom .
1514276 6/1978 United Kingdom .
2075028 11/1981 United Kingdom .
2095275 9/1982 United Kingdom .
2094826 9/1982 United Kingdom .

OTHER PUBLICATIONS

Segel, I., *Enzyme Kinetics,* Wiley-Interscience, N.Y., 1975.

Derwent Publications Limited Patent Abstract Accession No. 67228 E/32 relating to Japanese Patent Doc. No. J57 108-199.

*Primary Examiner*—Maria Parrish Tungol
*Attorney, Agent, or Firm*—James J. Farrell

[57] ABSTRACT

An improved laundry detergent composition which combines effective cleaning performance with effective textile softening performance on a wide range of textile materials comprises an anionic and/or nonionic surfactant and a synergistic mixture of a water-insoluble long chain $C_{10}$-$C_{26}$ tertiary amine and cellulase. The cellulase is preferably an alkali cellulase having an optimum pH of above 7 and is preferably used in an amount corresponding to a cellulase activity of from 0.25 to 150 or higher regular $C_x$ cellulase activity units/gram of the detergent composition.

10 Claims, No Drawings

DETERGENT COMPOSITIONS

This invention relates to detergent compositions that clean well and also act as textile softeners.

The current practice in providing a fabric softener benefit to fabrics in domestic laundering operations is to add a cationic fabric softener either as a liquid to the final rinse of the washing process or as a separate additive to a hot air tumbler dryer.

Numerous attempts have been made to formulate laundry detergent compositions that have both good cleaning properties and also textile softening properties so as to avoid the necessity of using a separate rinse-added textile softener product in addition to the usual laundry detergent. As cleaning by definition involves the removal of material from the textile surface and as textile softening normally involves deposition of material onto the same surface, these attempts have necessarily required a compromise in formulation to be reached between cleaning and softening performance.

The most common commercially available organic textile softening compounds are cationic materials that are reactive towards the anionic surfactants used in conventional laundry detergents. If both types of material are formulated in a single product, they tend to inter-act on addition to a wash liquor and, although in some instances the resulting complex has useful textile softening properties, its formation normally depresses the cleaning performance of the formulation and is therefore generally considered undesirable.

In order to overcome this problem, compositions have been proposed which have sought to minimise the mutual reactivity of the anionic and cationic materials by the addition of compatibilising compounds as described for example in U.S. Pat. Nos. 3,886,075 and 3,954,632.

An alternative approach has been to incorporate one of the reactant materials in a form that inhibits its contact with the other in the wash liquor and examples of this type of formulation are taught in U.S. Pat. Nos. 3,936,537 and 3,644,203. The performance of these compositions is however sensitive to the washing conditions that are employed. In an attempt to avoid the reactivity problem altogether, nonionic surfactants have been proposed in place of the conventional anionic surfactants and compositions of this type are described in e.g. British Patent Specn. No. 1,079,388, German Auslegeschrift No. 1 220 956 and U.S. Pat. No. 3,607,763. However, it has been found that levels of nonionic surfactant sufficient to provide good cleaning impair the softening of the cationic softener.

Another proposal to provide acceptable cleaning and textile softening by avoiding the surfactant-softener inter-action has been made in British Pat. Specn. No. 1,514,276, which teaches the use of certain long chain tertiary amines that are nonionic in character at the wash liquor pH existing when a conventional laundry detergent is used.

Unlike the cationic materials this type of softening agent does not substantially affect the cleaning performance of the detergent composition but, if used on its own, requires a high level of incorporation for effective softening performance.

In European patent application No. 0 026 528 there is described the use of such water-insoluble tertiary amines in conjunction with a water-soluble cationic quaternary ammonium compound and/or a water-soluble aliphatic amine, optionally with clays, in detergent compositions for providing fabric softening properties.

A further proposal has been to use cellulolytic enzymes, i.e. cellulase, as a harshness reducing agent in fabric softening compositions, as is taught in British Pat. Specn. No. 1,368,599.

The use of cellulase in detergent compositions has been further disclosed in GB No. 2,075,028; A; GB No. 2,095,275 A; GB No. 2,094,826 A and Jap. Pat. No. 57108-199.

A disadvantage of cellulases is however that they only have a softening effect on cellulose-containing fibres, i.e. cotton and cotton/polyester mixtures. Furthermore, if used on its own, cellulase requires a relatively high level of incorporation for effective single wash softening performance.

In summary therefore the prior art attempts to provide detergent compositions having textile softening capability have been of two general types. The first type has employed cationic fabric softening additives in anionic-surfactant based compositions and has sought to achieve the best compromise between these antagonistic components. The second type has replaced one or other of these components by a substitute which is not antagonistic but which requires a high level of incorporation for effective performance.

It has now been found that an improved detergent composition can be formulated which combines cleaning performance equivalent to that of commercially available heavy-duty laundry detergents together with effective textile softening performance on a wide range of textile materials, without the need of water-soluble cationic quaternary ammonium compounds and/or aliphatic amines and/or clay being present, by using a synergistic mixture of a long-chain tertiary amine and cellulase as the essential fabric softening ingredients.

According to the invention there is provided a detergent composition for the cleaning and softening of fabrics comprising:

(a) 2–50% by weight of an anionic surfactant and/or a nonionic surfactant, and (b) 0.5–15% by weight of a tertiary amine having the general formula

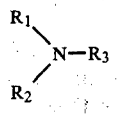

wherein $R_1$ is a $C_{10}$–$C_{26}$ alkyl or alkenyl group, $R_2$ is as $R_1$ or, if $R_1$ is a $C_{20}$–$C_{26}$ alkyl or alkenyl group, may be a $C_1$–$C_7$ alkyl group and $R_3$ has the formula $—CH_2—Y$ wherein Y is H, $C_1$–$C_6$ alkyl,

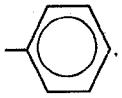

$—CH_2OH$, $—CH{=}CH_2$, $—CH_2CH_2OH$, $—CH_2CN$,

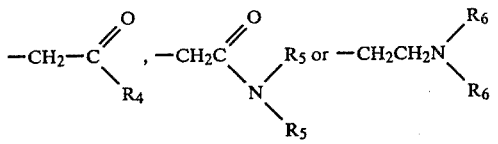

wherein $R_4$ is a $C_1$–$C_4$ alkyl group, each $R_5$ is independently H or $C_1$–$C_{20}$ alkyl; and each $R_6$ is independently H or $C_1$–$C_{20}$ alkyl; characterized in that it contains cellulase as component (c).

Preferably component (a) is an anionic surfactant or a mixture of anionic and nonionic surfactants. Component (b) preferably is a di $C_{16}$–$C_{22}$ alkyl $C_1$–$C_4$ alkyl amine in which the $C_{16}$–$C_{22}$ alkyl groups are derived from animal fats, and component (c) preferably is an alkali cellulase having an alkaline pH as its optimum pH.

In its broadest aspect the invention comprises three components, namely the anionic and/or nonionic surfactant component (a), the tertiary amine component (b), and the cellulase component (c).

(a) The Surfactant

A wide range of anionic surfactants can be used in the compositions of the present invention.

Suitable anionic non-soap surfactants are water-soluble salts of alkyl benzene sulphonates, alkyl sulphates, alkyl polyethoxy ether sulphates, paraffin sulphonates, alpha-olefin sulphonates, alpha-sulphocarboxylates and their esters, alkyl glyceryl ether sulphonates, fatty acid monoglyceride sulphates and sulphonates, alkyl phenol polyethoxy ether sulphates, 2-acyloxy-alkane-1-sulphonates, and beta-alkyloxy alkane sulphonates. Soaps are also suitable anionic surfactants.

Especially preferred alkyl benzene sulphonates have about 9 to about 15 carbon atoms in a linear or branched alkyl chain, more especially about 11 to about 13 carbon atoms. Suitable alkyl sulphates have about 10 to about 22 carbon atoms in the alkyl chain, more especially from about 12 to about 18 carbon atoms. Suitable alkyl polyethoxy ether sulphates have about 10 to about 18 carbon atoms in the alkyl chain and have an average of about 1 to about 12 —$CH_2CH_2O$— groups per molecule, especially about 10 to about 16 carbon atoms in the alkyl chain and an average of about 1 to about 6 —$CH_2CH_2O$— groups per molecule.

Suitable paraffin sulphonates are essentially linear and contain from about 8 to about 24 carbon atoms, more especially from about 14 to about 18 carbon atoms. Suitable alpha-olefin sulphonates have about 10 to about 24 carbon atoms, more especially about 14 to about 16 carbon atoms; alpha-olefin sulphonates can be made by reaction with sulphur trioxide, followed by neutralization under conditions such that any sultones present are hydrolyzed to the corresponding hydroxy alkane sulphonates. Suitable alpha-sulphocarboxylates contain from about 6 to about 20 carbon atoms; included herein are not only the salts of alpha-sulphonated fatty acids but also their esters made from alcohols containing about 1 to about 14 carbon atoms.

Suitable alkyl glyceryl ether sulphates are ethers of alcohols having about 10 to about 18 carbon atoms, more especially those derived from coconut oil and tallow. Suitable alkyl phenol polyethoxy ether sulphates have about 8 to about 12 carbon atoms in the alkyl chain and an average of about 1 to about 6 —$CH_2CH_2O$— groups per molecule. Suitable 2-acyloxy-alkane-1-sulphonates contain from about 2 to about 9 carbon atoms in the acyl group and about 9 to about 23 carbon atoms in the alkane moiety. Suitable beta-alkyloxy alkane sulphonates contain about 1 to about 3 carbon atoms in the alkyl group and about 8 to about 20 carbon atoms in the alkane moiety.

The alkyl chains of the foregoing non-soap anionic surfactants can be derived from natural sources such as coconut oil or tallow, or can be made synthetically as for example by using the Ziegler or Oxo processes. Water-solubility can be achieved by using alkali metal, ammonium, or alkanol-ammonium cations; sodium is preferred. Mixtures of anionic surfactants are contemplated by this invention; a satisfactory mixture contains alkyl benzene sulphonate having 11–13 carbon atoms in the alkyl group and alkyl sulphate having 12 to 18 carbon atoms in the alkyl group.

Suitable soaps contain about 8 to about 18 carbon atoms, more especially about 12 to about 18 carbon atoms. Soaps can be made by direct saponification of natural fats and oils such as coconut oil, tallow and palm oil, or by the neutralization of free fatty acids obtained from either natural or synthetic sources. The soap cation can be alkali metal, ammonium or alkanol-ammonium; sodium is preferred.

The compositions may contain from 0% to 50% of anionic detergent, preferably from 4% to 30% and normally from 5% to 15% of anionic detergent.

Nonionic surfactants may be incorporated in amounts of up to 100% by weight of the total surfactant, but normally are present in amounts of less than 75%. By total surfactant is meant the sum of the anionic surfactant and nonionic surfactant. Suitable nonionics are water-soluble ethoxylated materials of HLB 11.5–17.0 and include (but are not limited to) $C_{10}$–$C_{20}$ primary and secondary alcohol ethoxylates and $C_6$–$C_{10}$ alkylphenol ethoxylates. $C_{14}$–$C_{18}$ linear primary alcohols condensed with from seven to thirty moles of ethylene oxide per mole of alcohol are preferred, examples being $C_{14}$–$C_{15}$ $(EO)_7$, $C_{16}$–$C_{18}$ $(EO)_{25}$ and especially $C_{16}$–$C_{18}$ $(EO)_{11}$.

(b) The Tertiary Amine

Tertiary amines suitable for the purpose of the invention are highly water-insoluble compounds that have the general formula

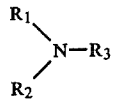

wherein $R_1$ is a $C_{10}$–$C_{26}$ alkyl or alkenyl group $R_2$ is the same as $R_1$ or if $R_1$ is a $C_{20}$–$C_{26}$ alkyl or alkenyl group, may be a $C_1$–$C_7$ alkyl group and $R_3$ has the formula —$CH_2$—Y, wherein Y is H, $C_1$–$C_6$ alkyl

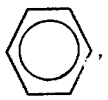

—$CH_2OH$, —CH=$CH_2$, —$CH_2CH_2OH$,

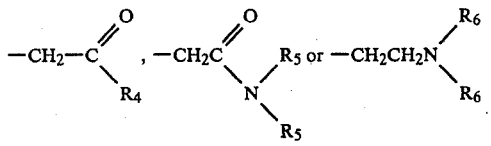

wherein $R_4$ is a $C_1$–$C_4$ alkyl group, each $R_5$ is independently H or $C_1$–$C_{20}$ alkyl; and each $R_6$ is independently H or $C_1$–$C_{20}$ alkyl.

Preferably $R_1$ and $R_2$ each independently represent a $C_{12}$–$C_{22}$ alkyl group, preferably straight-chained and $R_3$ is methyl, or ethyl. Suitable amines include di decyl methylamine
di lauryl methylamine
di myristyl methylamine
di cetyl methylamine
di stearyl methylamine
di arachadyl methylamine
di behenyl methylamine
arachadyl behenyl methylamine or
di (mixed arachidyl/behenyl) methylamine
di (tallowyl) methylamine
arachidyl/behenyl dimethylamine and the corresponding ethyl amines, propylamines and butylamines. Especially preferred is ditallowyl methylamine. This is commercially available as Armeen M2HT from Akzo N.V., as Genamin SH301 from Farbwerke Hoechst, and as Noram M2SH from the CECA Company.

When Y is

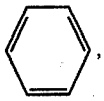

$-CH{=}CH_2$, $-CH_2OH$,

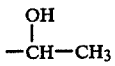

or $-CH_2-CN$, suitable amines include:

Didecyl benzylamine
dilauryl benzylamine
dimyristyl benzylamine
dicetyl benzylamine
distearyl benzylamine
dioleyl benzylamine
dilinoleyl benzylamine
diarachidyl benzylamine
dibehenyl benzylamine
di (arachidyl/behenyl) benzylamine
ditallowyl benzylamine and the corresponding allylamines, hydroxy ethylamines, hydroxy propylamines, and 2-cyanoethylamines. Especially preferred are ditallowyl benzylamine and ditallowyl allylamine.

Mixtures of any of these amines may be used.

The compositions should contain from 0.5% to 15% by weight of the tertiary amine, preferably from 1% to 10% by weight and most preferably from 2% to 5% by weight.

(c) The Cellulase

The cellulase usable in the present invention may be any bacterial or fungal cellulase having a pH optimum of between 5 and 11.5. It is however preferred to use cellulases which have optimum activity at alkaline pH values, such as those described in UK patent application GB No. 2,075,028 A; UK patent appln. GB No. 2,095,275 A and German patent appln. No. 2 247 832.

Examples of such alkaline cellulases are cellulases produced by a strain of Humicola insolens (Humicola grisea var. thermoidea), particularly the Humicola strain DSM 1800, and cellulases produced by a fungus of Bacillus N or a cellulase 212-producing fungus belonging to the genus Aeromonas, and cellulase extracted from the hepatopancreas of a marine mullosc (Dolabella Auricula Solander).

The cellulase added to the composition of the invention may be in the form of a non-dusting granulate, e.g. "marumes" or "prills", or in the form of a liquid in which the cellulase is provided as a cellulase concentrate suspended in e.g. a nonionic surfactant or dissolved in an aqueous medium, having cellulase activity of at least 250 regular $C_x$ cellulase activity units/gram, measured under the standard conditions as described in GB No. 2,075,028 A.

The amount of cellulase in the composition of the invention will, in general, be from about 0.1–10% by weight in whatever form. In terms of cellulase activity the use of cellulase in an amount corresponding to from 0.25 to 150 or higher regular $C_x$ units/gram of the detergent composition is within the scope of the present invention. A preferred range of cellulase activity, however, is from 0.5 to 25 regular $C_x$ units/gram of the detergent composition.

Optional Ingredients

The detergent compositions of the present invention may of course include, as optional ingredients, components that are usually found in laundry detergents.

These include zwitterionic surfactants, detergency builder salts, bleaching agents and organic precursors therefor, suds depression agents, soil-suspending and anti-redeposition agents, enzymes, e.g. proteolytic and amylolytic enzymes, optical brighteners, colouring agents and perfumes.

Detergency builder salts are a preferred component (d) of the compositions of the invention and can be inorganic or organic in character. Non-limiting examples of suitable water-soluble, inorganic alkaline detergent builder salts include the alkali metal carbonates, borates, phosphates, polyphosphates, bicarbonates, and silicates. Specific examples of such salts include the sodium and potassium tetraborates, bicarbonates, carbonates, triphosphates, pyrophosphates, penta-polyphosphates and hexametaphosphates. Sulphates are usually also present.

Examples of suitable organic alkaline detergency builder salts are:

(1) water-soluble amino polyacetates, e.g. sodium and potassium ethylenediaminetetraacetates, nitrilotriacetates, N-(2-hydroxyethyl) nitrilodiacetates and diethylene triamine pentaacetates;
(2) water-soluble salts of phytic acid, e.g. sodium and potassium phytates;
(3) water-soluble polyphosphonates, including sodium, potassium and lithium salts of methylenediphosphonic acid and the like and aminopolymethylene phosphonates such as ethylenediaminetetramethylenephosphonate and diethylene triaminepentamethylene phosphate, and polyphosphonates described in British patent application No. 38724/77.

(4) water-soluble polycarboxylates such as the salts of lactic acid, succinic acid, malonic acid, maleic acid, citric acid, carboxymethylsuccinic acid, 2-oxa-1,1,3-propane tricarboxylic acid, 1,1,2,2-ethane tetracarboxylic acid, mellitic acid and pyromellitic acid.

Mixtures of organic and/or inorganic builders can be used herein. One such mixture of builders is disclosed in Canadian Patent Specn. 755 038, e.g. a ternary mixture of sodium tripolyphosphate, trisodium nitrilotriacetate, and trisodium ethane-1-hydroxy-1,1-diphosphonate.

Another type of detergency builder material useful in the present compositions and processes comprise a water-soluble material capable of forming a water-insoluble reaction product with water hardness cations preferably in combination with a crystallization seed which is capable of providing growth sites for said reaction product. Such "seeded builder" compositions are fully disclosed in British Patent Specification No. 1,424,406.

Preferred water-soluble builders are sodium tripolyphosphate and sodium silicate, and usually both are present. In particular, it is preferred that a substantial proportion, for instance from 3 to 15% by weight of the composition of sodium silicate (solids) of ratio (weight ratio $SiO_2$:$Na_2O$) from 1:1 to 3.5:1 be employed.

A further class of detergency builder materials useful in the present invention are insoluble sodium aluminosilicates, particularly those described in Belgian Patent Specn. No. 814,874, issued Nov. 12, 1974. This patent specification discloses and claims detergent compositions containing sodium aluminosilicate of the formula:

$$Na_z(AlO_2)_z(SiO_2)_y xH_2O$$

wherein z and y are integers equal to at least 6, the molar ratio of z to y is in the range of from 1.0:1 to about 0.5:1 and x is an integer from about 15 to about 264. A preferred material is $Na_{12}(SiO_2AlO_2)_{12}27H_2O$. About 5% to 25% by weight of aluminosilicate may be used as a partial replacement for water-soluble builder salts, provided that sufficient water-soluble alkaline salts remain to provide the specified pH of the composition in aqueous solution.

The detergent builder salts are normally included in amounts of from 10% to 80% by weight of the composition, preferably from 20% to 70% and most usually from 30% to 60% by weight.

Bleaching agents useful in the compositions of the invention include sodium perborate, sodium percarbonate and other perhydrates at levels of from 5% to 35% by weight of the composition. Organic peroxy bleach precursors such as tetra acetyl ethylene diamine and tetra acetyl glycouril can also be included and these and other precursors are disclosed in German patent application No. 2 744 642.

In compositions incorporating oxygen bleaches, bleach stabilisers are also preferred components, usually at levels of from about 0.2% to 2% by weight of the composition. The stabilisers may be organic in nature such as the previously mentioned amino polyacetates and amino polyphosphonates or may be inorganic such as magnesium silicate. In the latter case the material may be added to the formulation or formed in situ by the addition of a water-soluble magnesium salt to a slurried detergent mix containing an alkali metal silicate.

Suds controlling agents are often present. These include suds boosting or suds stabilising agents such as mono- or di-ethanolamides of fatty acids. More often in modern detergent compositions, suds depressing agents are required. Soaps, especially those having ≦18 carbon atoms, or the corresponding fatty acids, can act as effective suds depressors if included in the anionic surfactant component of the present compositions. Usually about 1% to about 4% of such soap is effective as a suds suppressor. Very suitable soaps, when suds suppression is a primary reason for their use, are those derived from Hyfac (Trade Name for hardened marine oil fatty acids predominantly $C_{18}$ to $C_{22}$ acids available from the Humko Corporation).

However, non-soap suds suppressors are preferred in synthetic detergent-based compositions of the invention, since soap or fatty acid tends to give rise to a characteristic odour in these compositions.

Preferred suds suppressors comprise silicones. In particular there may be employed a particulate suds suppressor comprising silicone and silanated silica releasably enclosed in water-soluble or -dispersible substantially non-surface-active detergent impermeable carrier. Suds-depressing agents of this sort are disclosed in British Patent Specn. No. 1,407,997. A very suitable granular (prilled) suds-depressing product comprises 7% silica/silicone (15by weight silanated silica, 85% silicone, obtained from Messrs. Dow Corning), 65% sodium tripolyphosphate, 25% tallow alcohol condensed with 25 molar proportions of ethylene oxide, and 3% moisture. The amount of silica/silicone suds-suppressor employed depends upon the degree of suds suppression desired, but it is often in the range of from 0.01% to 0.5% by weight of the detergent composition. Other suds-suppressors which may be used are water-insoluble, preferably microcrystalline, waxes having a melting point in the range of from 35° to 125° C. and a saponification value of less than 100, as described in British Patent Specn. No. 1,492,938.

Yet other suitable suds suppressing systems are mixtures of hydrocarbon oil, a hydrocarbon wax and hydrophobic silica as described in European patent application No. 78 2000 035 and, especially, particulate suds-suppressing compositions comprising such mixtures, combined with an ethoxylated nonionic surfactant having an HLB in the range of from 14 to 19 and a compatibilising agent capable of forming inclusion compounds, such as urea. These particulate suds-suppressing compositions are described in European patent application No. 0 00 8830.

Soil-suspending agents are usually present at about 0.1 to 10%, such as water-soluble salts of carboxymethylcellulose, carboxyhydroxymethyl cellulose, polyethylene glycols of molecular weight of from about 400 to 10,000 and copolymers of methylvinylether and maleic anhydride or acid, available under the Trade Name Gantrez.

Proteolytic, amylolytic or lipolytic enzymes, especially proteolytic, and optical brighteners, of anionic, cationic or nonionic types, especially the derivatives of sulphonated triazinyl diamino stilbene may be present.

Photoactivated bleaches such as the tri and tetra sulphonated derivatives of zinc phthalocyanine are also useful components of the present composition.

Colours, non-substantive, and perfumes, as required to improve the aesthetic acceptability of the product, are usually incorporated.

Throughout the description herein where sodium salts have been referred to, potassium, lithium or ammonium or amine salts may be used instead if their extra cost etc., are justified for special reasons.

Preparation of the Compositions

The detergent compositions may be prepared in any way appropriate to their physical form, such as by dry-mixing the components, co-agglomerating them or dispersing them in a liquid carrier. However, a preferred physical form is a granule incorporating a detergency builder salt and this is most conveniently manufactured by spray-drying at least part of the composition. For the purpose of the following discussion, components of the composition that are normally added to a detergent crutcher mix and spray-dried are identified as (a), components which are applied in the liquid form by spray-on to other solid components are identified as (b) and components which are added as solids other than in the spray-dried portion are identified as (c).

Conventionally, the compositions are prepared by making up an aqueous slurry of the non-heat-sensitive components (a), comprising the anionic and/or non-ionic surfactants, builder and filler salts together with any soil-suspending agents and optical brighteners, and spray-drying this slurry. The moisture content of the slurry is normally in the range of 28% to 36% and its temperature is conveniently in the range of 70°–95° C. The spray-drying tower inlet temperatures are normally in the range of 300°–360° C. and the resultant spray-dried granules have a moisture content of 8–12% by weight. An optional, but preferred, additional processing step is to cool the dried granules rapidly by means of cool air from a temperature of 90° C. to a temperature in the range of 25°–35° C., in order to facilitate the further processing of the product. Solid heat-sensitive components (c), such as persalts and enyzmes, are mixed with the spray-dried granules. Although the water-insoluble amine component may be included in the slurry for spray-drying, it may degrade under certain processing conditions and adversely affect product quality. It is therefore preferred that the water-insoluble tertiary amine be liquefied by melting or solvent dissolution and that this liquid (b) be sprayed onto the spray-dried granules before or after other heat-sensitive solids have been dry-mixed with them. If the amine is applied as a melt, a liquid temperature of 5°–30° C. in excess of the melting point can conveniently be used for the spray-on. Since the amine is generally a waxy solid of rather low melting point, it may be blended with a compatible higher melting substance so as to ensure that granules sprayed on therewith are sufficiently crisp, and free-flowing and do not cake on storage.

The invention is illustrated by the following non-limiting examples.

EXAMPLE I

The following compositions were made up:

| (% by weight) | A | B | C |
|---|---|---|---|
| Sodium linear $C_{12}$ alkyl benzene sulphonate | 6.0 | 6.0 | 6.0 |
| $C_{13}$–$C_{15}$ fatty alcohol/ 11 ethylene oxide condensate | 3.0 | 3.0 | 3.0 |

-continued

| (% by weight) | A | B | C |
|---|---|---|---|
| Sodium soap | 2.0 | 2.0 | 2.0 |
| Sodium triphosphate | 33.0 | 33.0 | 33.0 |
| Sodium silicate (1:2) | 6.0 | 6.0 | 6.0 |
| Optical brightener | 0.2 | 0.2 | 0.2 |
| Sodium sulphate | 15.0 | 16.6 | 17.4 |
| Sodium perborate tetrahydrate | 24.0 | 24.0 | 24.0 |
| Proteolytic enzyme | 0.3 | 0.3 | 0.3 |
| Ditallowyl methylamine | 2.0 | — | 4.0 |
| Cellulase (445 reg. $C_x$ units/g) | 0.4 | 0.8 | — |
| Moisture and miscellaneous | 9.1 | 9.1 | 9.1 |

The compositions were used to wash different types of test swatches (10×10 cm) in a Tergotometer washing experiment using 10 g/l of product and a cloth:liquor ratio of 1:10 with 30° FH water. Each washing was carried out at 40° C. for 20 minutes.

The softening effects were rated by a team of panelists, scoring 1 as the best, 2 as second best, etc.

In the results below the better results are thus indicated by lower scores:

Softening effects score on:

| | A | B | C |
|---|---|---|---|
| (1) New cotton | | | |
| after 1 wash | 34 | 53 | 39 |
| after 3 washes | 33 | 42 | 51 |
| (2) Preharshened cotton | | | |
| after 1 wash | 32 | 44 | 42 |
| after 3 washes | 32 | 45 | 41 |
| (3) Acrylic | | | |
| after 1 wash | 33 | 47 | 43 |
| after 3 washes | 35 | 44 | 32 |

The above results clearly show that the tertiary amine/cellulase combination of the invention gives consistently better performance than the separate ingredients used alone at double the levels on new cotton and preharshened cotton after both one wash and repeated washes. Preharshened cotton is representative of used cotton fabrics which have been washed several times without sufficiently being softened.

On acrylic fabrics the combination of the invention gives better performance than the separate ingredients used alone at double the levels after one wash, better performance than cellulase alone used at double the level after repeated washes and comparable performance to tertiary amine alone used at double the level.

EXAMPLE II

The following compositions were made up:

| (% by weight) | D | E |
|---|---|---|
| Sodium linear $C_{12}$ alkyl benzene sulphonate | 5.5 | 5.5 |
| $C_{13}$–$C_{15}$ fatty alcohol/ 11 ethylene oxide condensate | 3.0 | 3.0 |
| Sodium soap | 2.0 | 2.0 |
| Sodium triphosphate | 30.0 | 30.0 |
| Sodium silicate (1:2) | 5.5 | 5.5 |
| Optical brightener | 0.2 | 0.2 |
| Sodium sulphate | 20.1 | 21.7 |
| Sodium perborate tetrahydrate | 21.0 | 21.0 |
| Proteolytic enzyne | 0.3 | 0.3 |
| Ditallowyl methylamine | 2.0 | — |
| Cellulase (445 reg. $C_x$ units/g) | 0.4 | 0.8 |
| Moisture and miscellaneous | 10.0 | 10.0 |

The compositions were used to wash different types of test swatches (10×10 cm) in a Tergotometer washing experiment using 10 g/l of product and a cloth:liquor ratio of 1:10 with 30° FH water. Each washing was carried out at 40° C. for 20 minutes.

The softening effects were rated by a team of panelists, scoring 1 as the best, 2 as second best, etc.

In the results below the better results are thus indicated by lower scores:

Softening effects score on:

| | D | E |
|---|---|---|
| (1) New cotton | | |
| after 3 washes | 45 | 55 |
| (2) Preharshened cotton | | |
| after 3 washes | 40 | 45 |
| (3) Acrylic | | |
| after 1 wash | 38 | 53 |
| after 3 washes | 44 | 62 |

The superior fabric softening effects rated for the composition D of the invention over Composition E containing cellulase alone at double the level of that used in Composition D on all three fabric types tested, especially after repeated washes, are evident.

I claim:

1. A detergent composition for the cleaning and simultaneous softening of fabrics, comprising:

(a) 2–50% by weight of a surfactant selected from the group consisting of anionic and nonionic surfactants and mixtures thereof in conjunction with:

(b) 0.5–15% by weight of a tertiary amine having the general formula:

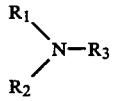

wherein $R_1$ is a $C_{10}$–$C_{26}$ alkyl or alkenyl group, $R_2$ is as $R_1$ or, if $R_1$ is a $C_{20}$–$C_{26}$ alkyl or alkenyl group, may be a $C_1$–$C_7$ alkyl group and $R_3$ has the formula —$CH_2$—Y wherein Y is H, $C_1$–$C_6$ alkyl,

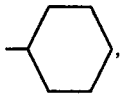

—$CH_2OH$, —CH=$CH_2$, —$CH_2CH_2OH$, —$CH_2CN$,

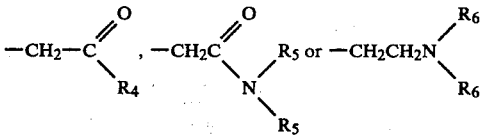

wherein $R_4$ is a $C_1$–$C_4$ alkyl group, each $R_5$ is independently H or $C_1$–$C_{20}$ alkyl; and each $R_6$ is independently H or $C_1$–$C_{20}$ alkyl; and (c) cellulase, forming together the essential fabric softening ingredients.

2. A detergent composition according to claim 1, wherein the cellulase is bacterial or fungal cellulase having a pH optimum of between 5 and 11.5.

3. A detergent composition according to claim 2 wherein the cellulase is alkali cellulase having a pH optimum from 7 to 11.

4. A detergent composition according to claim 3 wherein the cellulase is alkali cellulase having a pH optimum from 7.5 to 11.0.

5. A detergent composition according to claim 1 wherein the cellulase is present in the form of a non-dusting granulate having a cellulase activity of at least 250 regular $C_x$cellulase activity units/gram.

6. A detergent composition according to claim 5 wherein the cellulase is present in an amount of from about 0.1–10% by weight of the composition.

7. A detergent composition according to claim 1 wherein the composition has a cellulase activity of from 0.25 to 150 regular $C_x$ units/gram.

8. A detergent composition according to claim 7 wherein the cellulase activity is from 0.5 to 25 regular $C_x$ units per gram of composition.

9. A detergent composition according to claim 1 wherein the tertiary amine is selected from compounds in which $R_1$ and $R_2$ are each independently $C_{12}$–$C_{22}$ alkyl groups and $R_3$ is a methyl or ethyl group.

10. A detergent composition according to claim 9 wherein the tertiary amine is ditallowyl methyl amine.

* * * * *